US011555268B2

(12) United States Patent
Jung et al.

(10) Patent No.: US 11,555,268 B2
(45) Date of Patent: Jan. 17, 2023

(54) DETERGENT SUPPLY DEVICE AND LAUNDRY TREATING APPARATUS INCLUDING THE SAME

(71) Applicant: LG Electronics Inc., Seoul (KR)

(72) Inventors: Sungwoon Jung, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 57 days.

(21) Appl. No.: 17/006,539

(22) Filed: Aug. 28, 2020

(65) Prior Publication Data

US 2021/0062396 A1 Mar. 4, 2021

(30) Foreign Application Priority Data

Aug. 29, 2019 (KR) ..... 10-2019-0106713
Feb. 11, 2020 (KR) ..... 10-2020-0016560

(51) Int. Cl.
*D06F 39/02* (2006.01)

(52) U.S. Cl.
CPC ..... *D06F 39/022* (2013.01); *D06F 39/028* (2013.01)

(58) Field of Classification Search
None
See application file for complete search history.

(56) References Cited

U.S. PATENT DOCUMENTS 7,257,969 B2 * 8/2007 Kim ..... D06F 39/028 68/17 R
2014/0076009 A1 * 3/2014 Kim ..... D06F 39/083 68/17 R
2016/0287051 A1 10/2016 Hendrickson
2017/0321368 A1 11/2017 Favaro et al.
(Continued)

FOREIGN PATENT DOCUMENTS

CN 101307556 11/2008
CN 202744829 2/2013
CN 202913249 5/2013
(Continued)

OTHER PUBLICATIONS

RU Notice of Allowance in Russian Appln. No. 2020127885, dated Mar. 17, 2021, 21 pages (with English translation).
(Continued)

*Primary Examiner* — Cristi J Tate-Sims
(74) *Attorney, Agent, or Firm* — Fish & Richardson P.C.

(57) ABSTRACT

A detergent supply device includes a housing disposed to extend in one direction; a storage container frame withdrawably mounted in the housing; a first storage container and a second storage container in which different first and second laundry detergents are respectively stored, and mounted in parallel to each other in the storage container frame; and a laundry detergent pump provided at a rear portion of the housing to move each laundry detergent accommodated in the first and second storage containers toward the housing, wherein a laundry detergent passage is disposed on a lower
(Continued)

surface of the housing to extend so as to move laundry detergent introduced thereinto toward a detergent input hole, and the laundry detergent passage is divided into different movement paths by a separation wall, and a laundry treating apparatus including the same.

18 Claims, 9 Drawing Sheets

(56) References Cited

U.S. PATENT DOCUMENTS

2018/0171530 A1* 6/2018 Hendrickson ..... D06F 39/022

FOREIGN PATENT DOCUMENTS

| | | |
|---|---|---|
| CN | 103276564 | 9/2013 |
| CN | 103422328 | 12/2013 |
| CN | 105308230 | 2/2016 |
| CN | 105937145 | 9/2016 |
| CN | 106245278 | 12/2016 |
| CN | 106884284 | 6/2017 |
| CN | 107164919 | 9/2017 |
| CN | 107523968 | 12/2017 |
| EP | 3221499 | 9/2017 |
| FR | 2571390 | 4/1986 |
| GB | 2187763 | 9/1987 |
| JP | 2017074080 | 4/2017 |
| KR | 100471446 | 3/2005 |
| KR | 1020090122003 | 11/2009 |
| RU | 2541749 | 2/2015 |
| RU | 2544128 | 3/2015 |
| RU | 2597534 | 9/2016 |
| WO | WO2016078719 | 5/2016 |

OTHER PUBLICATIONS

Extended European Search Report in European Application No. 20191892.7, dated Dec. 21, 2020, 10 pages.

Office Action in Chinese Appln. No. 202010877305.6, dated Jul. 22, 2022, 16 pages (with English translation).

* cited by examiner

DETERGENT SUPPLY DEVICE AND LAUNDRY TREATING APPARATUS INCLUDING THE SAME

CROSS-REFERENCE TO RELATED APPLICATIONS

Pursuant to 35 U.S.C. § 119(a), this application claims the benefit of an earlier filing date of and the right of priority to Korean Patent Application Nos. 10-2019-0106713 and 10-2020-0016560, filed Aug. 29, 2019 and Feb. 11, 2020, respectively, the contents of which are incorporated by reference herein in their entirety.

BACKGROUND

1. Technical Field

The present disclosure relates to a detergent supply device for automatically supplying laundry detergent and a laundry treating apparatus including the same.

2. Description of the Related Art

The laundry treating apparatus is an apparatus for putting clothing, bedding or the like (hereinafter, referred to as laundry) into the drum to remove contamination from the laundry. A user may accommodate laundry to be treated in the laundry treating apparatus and supply detergent or softener to treat the laundry.

The laundry treating apparatus may include a tub accommodated inside a main body forming an outer appearance, a drum rotatably mounted inside the tub to put laundry thereinto, and a detergent supply device for supplying detergent into the drum.

The detergent supply device performs a function of supplying laundry detergent to supply detergent (hereinafter, referred to as a "laundry detergent") so as to enhance the washing effect of laundry put in the drum.

Here, the laundry detergent means a substance that enhances the washing effect, such as textile detergent, fabric softener, and fabric bleach. For the laundry detergent, powder type laundry detergent or liquid type laundry detergent may be used.

In recent years, there is a problem in that the detergent component is not dissolved after washing and remains in the water tank or the laundry due to its insufficient solubility, and thus, the use of liquid laundry detergent with excellent solubility instead of powder type laundry detergent is gradually increased.

Korean Patent Registration No. 10-0471446 discloses a detergent supply device having a structure in which a water overflow step is disposed in a water storage pool communicating with a detergent storage unit to prevent detergent from remaining inside the detergent storage unit. Through this, an amount of detergent added to the tub may be controlled in a quantitative manner, but when the user adds an excessive amount, there is a problem of causing damage to laundry or excessive use of wash water.

Furthermore, it is inconvenient because the user has to manually open a door to supply laundry detergent and then manually put the laundry detergent into a detergent storage container provided inside the door, and there is a concern that trivial failures may occur due to fatigue accumulation while frequently opening and closing a drawer for the supply of detergent or softener.

Accordingly, in recent years, a detergent supply device capable of supplying a required amount of laundry detergent to a tub according to its established laundry treating process when a user operates a laundry treating apparatus in a state where detergent or softener is put in a storage container separately provided in the laundry treating apparatus is mainly used. In this case, the user does not need to supply detergent or softener every time the laundry treating process is performed, thereby further improving the user's convenience.

However, when laundry detergent stored in the detergent storage container is supplied according to the laundry treating process, there is a concern of being contaminated due to the generation of sediment while being mixed with each other, and it may cause difficulty in efficiently supplying laundry detergent due to obstruction of the movement of laundry detergent when sediment is generated. In addition, it may degrade the user's satisfaction due to poor aesthetics when removing the storage container, and sediment may move to the tub and contaminate the laundry during the washing process.

SUMMARY

A first aspect of the present disclosure is to provide a detergent supply device capable of storing a large amount of laundry detergent and automatically supplying laundry detergent stored therein to a drum so as to enhance a user's convenience, and a structure of a laundry treatment apparatus including the same.

A second aspect of the present disclosure is to provide a detergent supply device capable of forming movement paths for different laundry detergents, respectively, so as to prevent the laundry detergents having different viscosities from being mixed, and a structure of a laundry treating apparatus including the same.

A third aspect of the present disclosure is to provide a detergent supply device capable of efficiently moving each laundry detergent toward a detergent input hole so as to properly perform the supply of laundry detergents to a tub, and a structure of a laundry treating apparatus including the same.

In order to achieve an object of the present disclosure, there may be provided a detergent supply device, including a housing disposed to extend in one direction; a storage container frame withdrawably mounted in the housing; a first storage container and a second storage container in which different first and second laundry detergents are respectively stored, and mounted in parallel to each other in the storage container frame; and a laundry detergent pump provided at a rear portion of the housing to move each laundry detergent accommodated in the first and second storage containers toward the housing, wherein a laundry detergent passage is disposed on a lower surface of the housing to extend so as to move laundry detergent introduced thereinto toward a detergent input hole, and the laundry detergent passage is divided into different movement paths by a separation wall.

According to an example of the present disclosure, the laundry detergent passage may include a first laundry detergent passage that guides the movement of the first laundry detergent; and a second laundry detergent passage spaced apart from the first laundry detergent passage to guide the movement of the second laundry detergent, wherein the first laundry detergent passage and the second laundry detergent passage are separated from each other with a separation wall therebetween to limit the mixing of the first and second laundry detergents.

According to an example of the present disclosure, an inclined portion may be disposed to have a predetermined inclination toward the detergent input hole at either one side portion on a lower surface of the housing.

According to an example of the present disclosure, the separation wall may be disposed to extend along a gap between the first laundry detergent passage and the second laundry detergent passage from a rear surface of the housing toward the inclined portion.

According to an example of the present disclosure, at least either one of the first laundry detergent passage and the second laundry detergent passage may extend to the inclined portion.

According to an example of the present disclosure, at least either one of the first laundry detergent passage and the second laundry detergent passage may increase in width in a region adjacent to the inclined portion.

According to an example of the present disclosure, both ends of the first and second laundry detergent passages may be disposed to communicate with a rear surface of the housing and the detergent input hole, respectively.

According to an example of the present disclosure, the laundry detergent pump may supply laundry detergent accommodated in the first and second storage containers to a rear surface of the housing.

According to an example of the present disclosure, the first and second laundry detergent passages may communicate with each other at a rear portion of the housing.

According to an example of the present disclosure, the first and second laundry detergent passages may have different lengths from a rear surface of the housing to the detergent input hole.

According to an example of the present disclosure, each laundry detergent may be mixed with wash water supplied to the housing, and discharged through the detergent input hole.

According to an example of the present disclosure, the detergent supply device may further include a wash water dispenser provided to face an upper portion of the each storage container to form a movement path of wash water flowing in from the outside.

According to an example of the present disclosure, wash water supply portions may be disposed at both sides of a rear portion of the wash water dispenser to supply the wash water in a downward direction through a plurality of holes arranged in the wash water supply portion.

According to an example of the present disclosure, a gap having a predetermined distance may be disposed between the housing and the storage container frame, and a wash water supply portion that supplies wash water may be disposed at an upper side of the gap.

According to an example of the present disclosure, a manual detergent dispensing unit may be disposed between the first storage container and the second storage container to add laundry detergent thereto by a user.

According to an example of the present disclosure, powder detergent added through the manual detergent dispensing unit may fall into a detergent input hole or an inclined portion to be supplied to the housing.

In order to achieve an objection of the present disclosure, a laundry treating apparatus having the foregoing structure may include:

a tub provided inside a main body, and a drum rotatably provided inside the tub; and a detergent supply device provided to be inserted into or withdrawn from a front surface of the main body to supply laundry detergent toward the tub, wherein the detergent supply device includes a housing disposed to extend in one direction; a storage container frame withdrawably provided with respect to the housing; a first storage container and a second storage container in which different first and second laundry detergents are respectively stored, and mounted in parallel to each other in the storage container frame; and a laundry detergent pump provided at a rear portion of the housing to move each laundry detergent accommodated in the first and second storage containers toward the housing, and a laundry detergent passage is disposed on a lower surface of the housing to extend so as to move laundry detergent introduced thereinto toward a detergent input hole, and the laundry detergent passage is divided into different movement paths by a separation wall.

According to an example of the present disclosure, the laundry detergent passage may include a first laundry detergent passage that guides the movement of the first laundry detergent; and a second laundry detergent passage spaced apart from the first laundry detergent passage to guide the movement of the second laundry detergent, and the first laundry detergent passage and the second laundry detergent passage may be disposed at a lower surface of the housing to be separated from each other by interposing a separation wall protruding to have a preset height toward the upper portion therebetween.

According to an example of the present disclosure, both ends of the first and second laundry detergent passages may communicate with a rear portion of the housing and the detergent input hole, respectively.

According to an example of the present disclosure, an inclined portion having a predetermined inclination in a direction toward the detergent input hole may be disposed at either one side portion on a lower surface of the housing. Furthermore, the inclined portion may also be disposed at both side portions of a lower surface of the housing.

According to an example of the present disclosure, the first laundry detergent passage and the second laundry detergent passage may increase in width in a direction toward the detergent input hole in a region adjacent to the inclined portion. For example, one end of a first laundry detergent passage or one end of a second laundry detergent passage may be disposed to increase in width in a direction toward the detergent input hole.

According to an example of the present disclosure, a lower surface of the housing may be configured to be inclined at a preset angle from the rear portion to the front portion to face the detergent input hole.

According to an example of the present disclosure, the detergent supply device may further include a wash water dispenser fixedly provided inside the main body such that a bottom surface portion thereof is located to face an upper portion of the storage container when the housing is mounted to the main body so as to define a movement path of wash water flowing in from the outside.

According to an example of the present disclosure, the each laundry detergent may be mixed with wash water supplied to the housing, and then discharged along the detergent input hole to move toward the tub. Wash water is not only supplied toward a lower portion of the housing into which laundry detergent is added, but also dropped toward an inclined portion thereof to move toward the detergent input hole in a state of being mixed with the laundry detergent.

The effects of the present disclosure obtained through the above-described solutions are as follows.

First, the detergent supply device may store a large amount of laundry detergent through a storage container capable of storing different laundry detergents. Furthermore, it may be possible to automatically supply an appropriate amount of laundry detergent toward the tub through the operation of the laundry detergent pump in the washing process, and as the need arises, the user may directly put a desired amount of laundry detergent into the manual detergent dispensing unit, thereby further enhancing the user's convenience.

Second, on a lower surface of the housing of the detergent dispensing device, laundry detergent passages may be disposed to allow the movement of different laundry detergents, and the respective laundry detergents may be separated from each other by a separation wall disposed between the respective laundry detergent passages, thereby preventing the laundry detergents from being mixed.

Third, laundry detergent moving toward a detergent input hole along the laundry detergent passage may be configured to increase a width of the laundry detergent passage along the inclined portion so as to more efficiently move the laundry detergent, thereby properly supplying the laundry detergent according to a washing process.

DETAILED DESCRIPTION

Hereinafter, a laundry treating apparatus associated with the present disclosure will be described in more detail with reference to the accompanying drawings.

According to the present specification, the same or similar elements are designated with the same numeral references even in different embodiments and their redundant description will be omitted.

Furthermore, a structure applied to any one embodiment may be also applied in the same manner to another embodiment if they do not structurally or functionally contradict each other even in different embodiments.

A singular representation may include a plural representation as far as it represents a definitely different meaning from the context.

In describing the embodiments disclosed herein, the detailed description will be omitted when specific description for publicly known technologies to which the invention pertains is judged to obscure the gist of the present disclosure.

It should be understood that the accompanying drawings are merely illustrated to easily explain the concept of the invention, and therefore, they should not be construed to limit the technological concept disclosed herein by the accompanying drawings, and the concept of the present disclosure should be construed as being extended to all modifications, equivalents, and substitutes included in the concept and technological scope of the invention.

Figure 1:
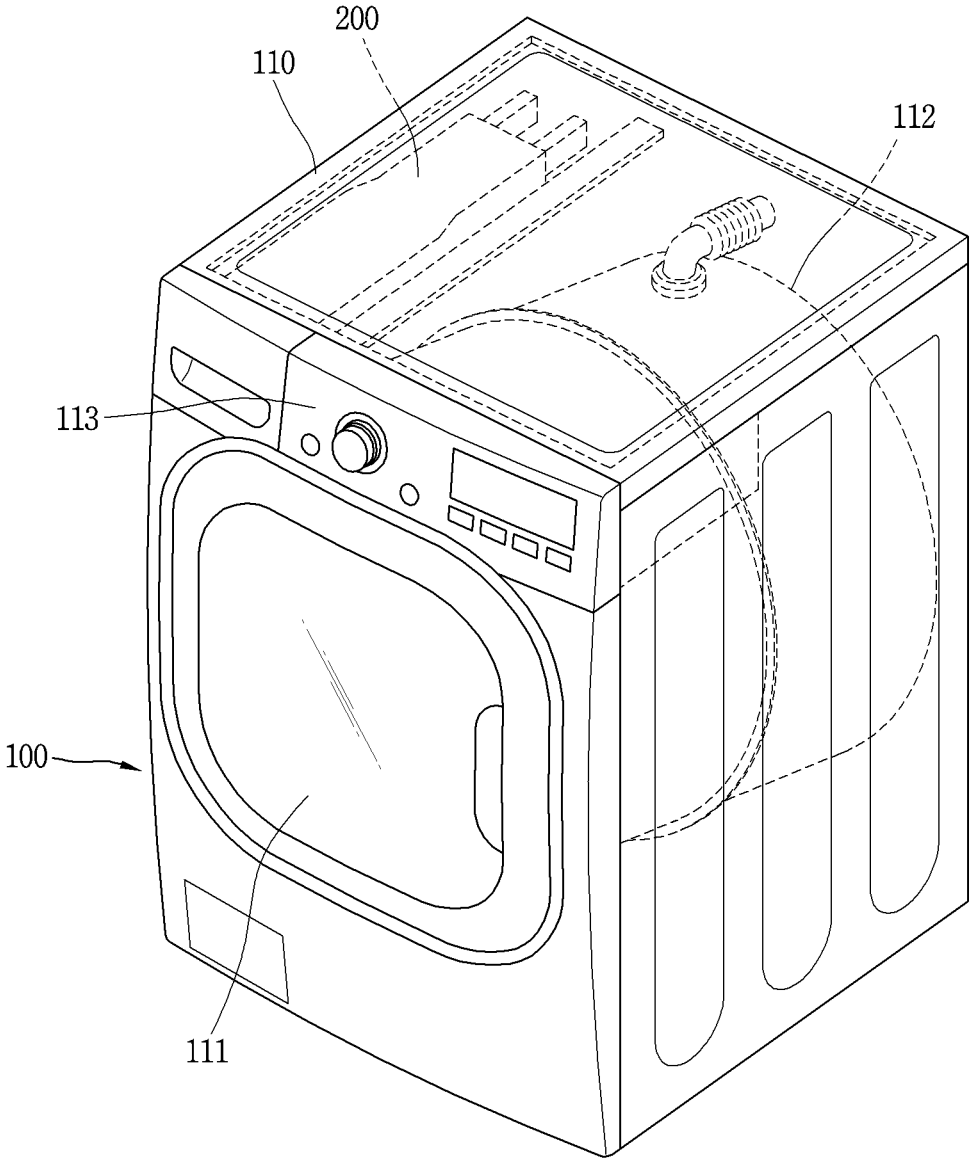
FIG. 1 is a perspective view illustrating a laundry treating apparatus according to the present disclosure.

FIG. 1 is a perspective view illustrating a laundry treating apparatus 100 according to the present disclosure.

The laundry treating apparatus 100 may include a washer for inserting laundry into a washing tub and then performing a laundry treating operation such as washing, rinsing, and dehydration, through laundry detergent being added thereto, a dryer for inserting wet fabric to perform drying, and the like.

Here, "laundry detergent" denotes detergent, softener, and bleach in the form of powder, solid or liquid as a material used to sterilize, disinfect laundry or fabric, or remove impurities.

Specifically, the laundry detergent may denote fabric softener for softening laundry, fabric or the like, and the laundry detergent may denote bleach that degrades or removes colored substances contained in laundry or fabric through chemical action to whiten the fabric or the like.

In general, the laundry treating apparatus may be divided into a top-loading type and a front-loading type. FIG. 1 shows an example of a front-loading type laundry treating apparatus 100. However, the technical concept of the present disclosure may be applicable not only to the front-loading type laundry treating apparatus as shown in FIG. 1, but also to a top-loading type laundry treating apparatus.

As shown in FIG. 1, the laundry treating apparatus 100 has a structure including a main body 110 defining an outer appearance, an operation unit 113 that receives various control commands from a user and has a display module for displaying information on an operation state, and a door 111 rotatably provided at a front portion of the main body 110 to allow the entry and exit of laundry.

The main body 110 may define an outer appearance of the laundry treating apparatus 100, and may be provided with a space capable of receiving various components constituting the laundry treating apparatus 100 inside the main body 110. A drum 112 for receiving laundry loaded through the door 111 may be provided inside the main body 110.

The drum 112 may include an outer tub (not shown) filled with wash water, and an inner tub (not shown) provided to be rotatable inside the outer tub (not shown) to receive laundry. One side of the drum 112 may be provided with a balancer (not shown) to compensate for eccentricity caused by rotation.

The operation unit 113 may be provided on a front portion of the main body 110, and may include various operation keys for operating the operation state of the laundry treating apparatus 100 and a display for displaying the operation state of the laundry treating apparatus 100.

The door 111 serves to open and close an entrance hole of laundry, and may be made of a transparent member such as tempered glass to look inside the main body 110.

The laundry treating apparatus 100 may include a detergent supply device 200.

The detergent supply device 200 may be provided at an upper side of the main body 110. The detergent supply device 200 stores laundry detergent, and serves to automatically supply laundry detergent into the drum 112 during a washing process. Here, the laundry detergent denotes a material capable of enhancing the washing effect of laundry, as described above, and may denote liquid fabric detergent and liquid fabric softener.

Figure 2:
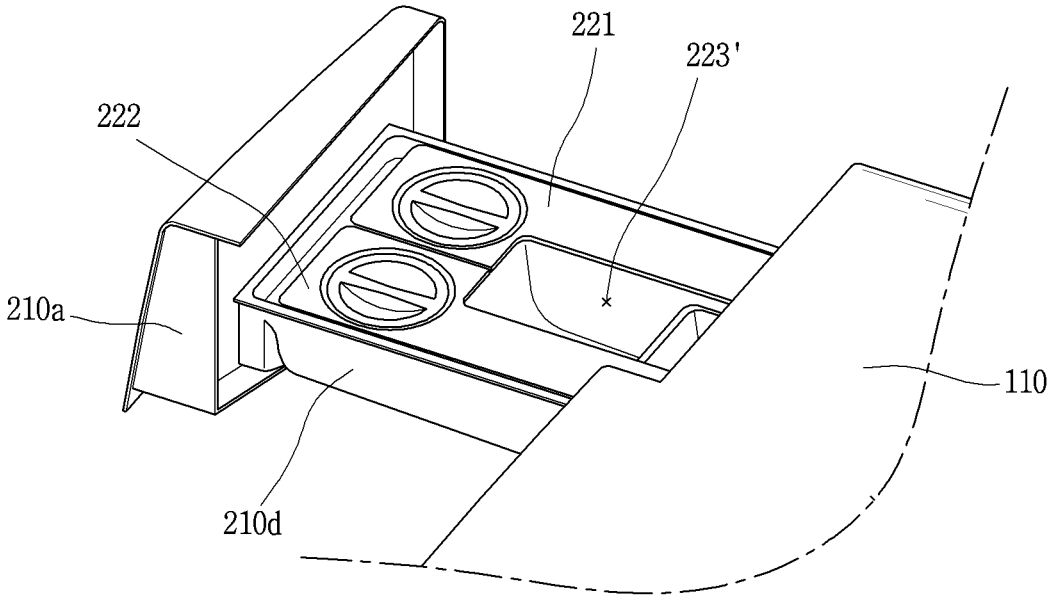
FIG. 2 is a conceptual view showing a state when a detergent supply device is withdrawn from a main body.

FIG. 2 is a conceptual view illustrating a state in which the detergent supply device 200 is withdrawn from the main body 110.

The detergent supply device 200 may include laundry storage containers 221, 222 mounted on a storage container frame 210*d* defining an outer appearance. When the user grips a front portion 210*a* of the storage container frame 210*d* and then pulls it out, the detergent supply device 200 may be slidably withdrawn from a front portion of the main body 110 of the laundry treating apparatus to expose at least part thereof to the outside. In addition, when the user pushes the front portion 210*a* toward the main body 110, the detergent supply device 200 may be mounted on the housing 210 provided in the main body 110 while being slid in a direction toward the main body.

As shown in FIG. 2, when the detergent supply device 200 is withdrawn from the main body, a plug 224 of the storage container 221, 222, a manual detergent dispensing unit 223' and a softener housing receiving portion 223 may be exposed to the outside, and the user may withdraw the detergent supply device 200 from the main body, and then replenishes laundry detergent in the storage container 221, 222, or add laundry detergent to the manual detergent dispensing unit 223' and the softener housing receiving portion 223.

Figure 3A:
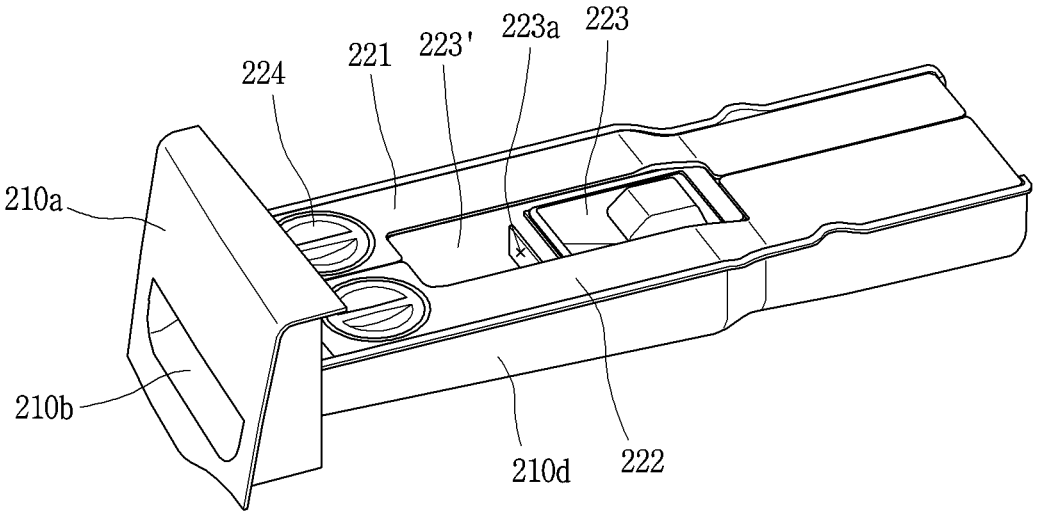
FIG. 3A is a perspective view showing a state in which the detergent supply device is completely withdrawn out to the outside.
Figure 3B:
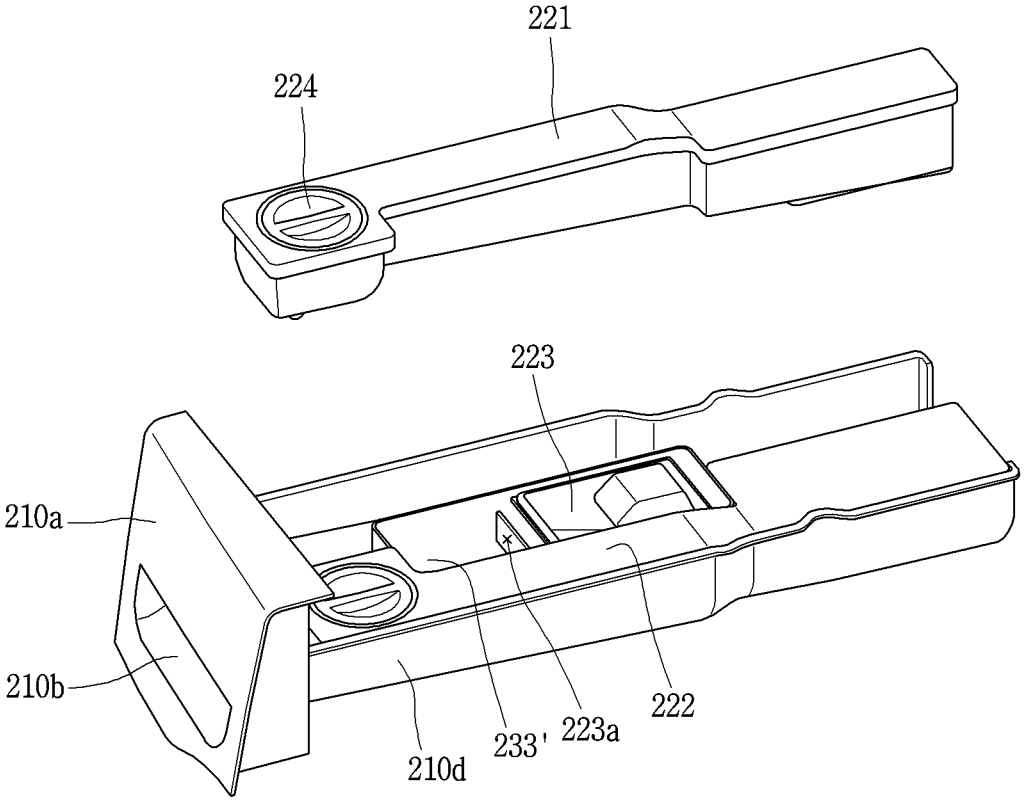
FIG. 3B is an exploded perspective view of the detergent supply device in FIG. 3A.

FIG. 3A is a perspective view showing a state in which the detergent supply device is completely withdrawn out to the outside, and FIG. 3B is an exploded perspective view of the detergent supply device in FIG. 3A.

The detergent supply device 200 may be made to be withdrawn from or inserted into the main body 110 by the user. When the user grips a front portion 211 of the storage container frame 210 and then pulls it out, the detergent supply device 200 may be withdrawn out in a sliding manner from a front portion of the main body 110. When the detergent supply device 200 is withdrawn from the main body 110, at least part of the storage containers 221, 222 may be exposed to the outside.

A plurality of detergent storage containers 221, 222 may be provided inside the storage container frame 210*d*. Inside the storage container frame 210*d*, a first storage container 221 and a second storage container 222 in which first and second laundry detergents are stored therein, respectively, may be mounted to store different laundry detergents therein.

Here, the first laundry detergent may denote liquid detergent, and the second laundry detergent may denote fabric softener. In addition, the first laundry detergent may denote fabric softener, and the second laundry detergent may denote detergent.

The volumes of laundry detergents that can be accommodated in the first storage container 221 and the second storage container 222 may be made to be similar to each other. However, considering that detergent is used more than softener in a general laundry treating process, the capacity of laundry detergent that can be accommodated in either one storage container may be configured to be larger, and liquid detergent may be accommodated in the storage container.

In other words, the first storage container 221 and the second storage container 222 may accommodate either one of detergent and softener therein, and there are some differences in their shapes, but it can be seen that the structure and function thereof correspond to each other.

When the first and second storage containers 221, 222 are inserted into the housing 210 while being mounted in the storage container frame 210*d*, the first storage container 221 and the second storage container 222 may be in communication with the laundry detergent pumps 231, 232 (see FIG. 4) provided on the rear surface to supply detergent or softener stored therein to a tub (not shown) of the laundry treating apparatus by the laundry detergent pumps 231, 232.

The first storage container 221 and the second storage container 222 may be defined in a shape of a container extending in a front-rear direction of the main body 1110, and provided with a space capable of storing a predetermined amount of laundry detergent therein.

As shown in FIG. 3B, the first storage container 221 and the second storage container 222 may be defined in a "□"-shape, and the first storage container 221 and the second storage container 222 may be mounted inside the storage container frame 210*d* to face each other.

A lower surface of the first storage container 221 and the second storage container 222 may be disposed to have a predetermined inclination, thereby facilitating the flow of laundry detergent accommodated in each of the storage containers 221, 222. The laundry detergent stored in the first storage container 221 and the second storage container 222 must be supplied toward the tub through the laundry detergent pumps 231, 232, and thus the lower surface thereof may be disposed to be inclined with a predetermined inclination toward the rear side.

Each storage container 221, 222 may include a receiving portion (internal space) in which laundry detergent is accommodated, and a cover that covers each receiving portion to limit external exposure of the laundry detergent.

Furthermore, the first storage container 210 and the second storage container 220 may be mounted at one side of the storage container frame 210*d* to face each other, and thus the manual detergent dispensing unit 223' may be disposed between the first storage container 210 and the second storage container 220, thereby allowing the user to manually put detergent therein. The manual detergent dispensing unit 223' may be configured with a predetermined space formed between the first storage container 221 and the second storage container 222.

In addition, the softener housing receiving portion 223 configured with a predetermined space in parallel to the manual detergent dispensing unit 223' in a front-rear direction to manually add fabric softener thereto may be disposed.

The softener housing receiving portion 223 may be configured to have a predetermined space to manually supply softener, and a softener housing (not shown) may be provided. The softener housing (not shown) may be mounted to fit into the softener housing receiving portion 223 so as to be spaced apart by a predetermined distance. Accordingly, when softener is supplied toward the softener housing and the softener overflows, it may move between the softener housing and the softener housing receiving portion 223 to move toward the detergent input hole 214, which will be described later.

The plug 224 may be provided in the first storage container 221 and the second storage container 222, respectively. The plug 224 may be detachable from the storage container 221, 222 when rotated in one direction. Accordingly, when the plug 224 is removed from the storage container 221, 222, the user will be able to supply laundry detergent to the storage container 221, 222.

For example, when the user notices a lack of laundry detergent on the operation panel 113 of the laundry treating apparatus 100, the user may withdraw the storage container frame 210*d* from the housing 210, and then remove the plug 224 coupled to the storage containers 221, 222 exposed to the outside by rotating it in one direction, and then replenish laundry detergent such as detergent or softener.

Figure 4:
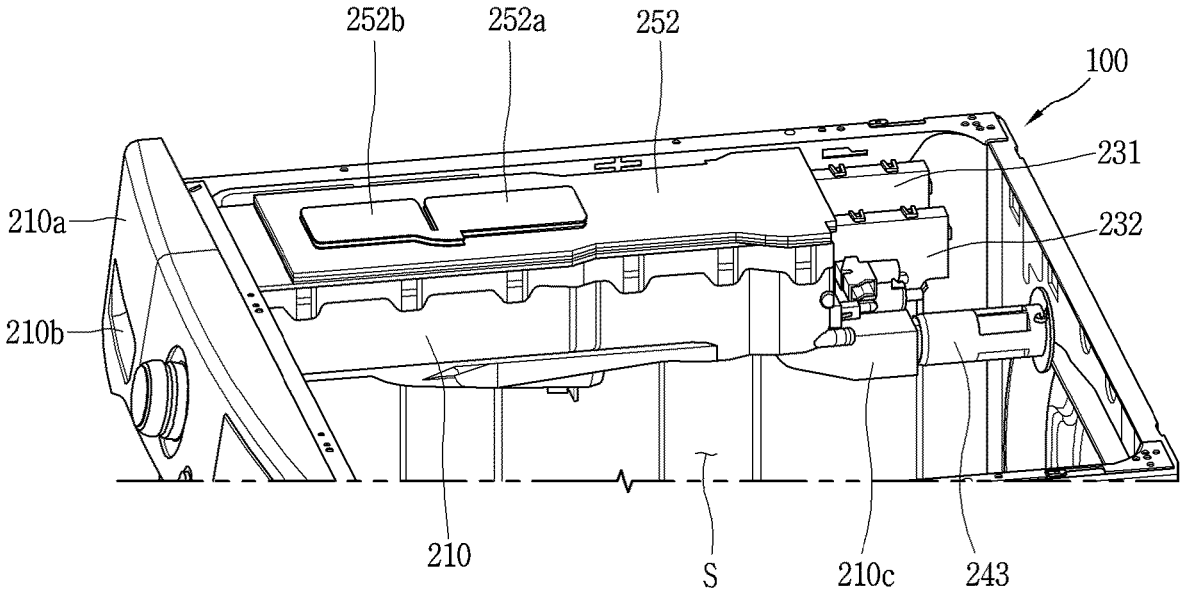
FIG. 4 is a perspective view illustrating an inner upper portion of the laundry treating apparatus.

FIG. 4 is a perspective view illustrating an inner upper portion of the laundry treating apparatus 100.

The main body 110 may define an outer appearance of the laundry treating apparatus 100, and an inner space (S) may be formed by front, rear and side surfaces of the main body 110 inside the main body 110. The inner space (S) may be configured to be opened and closed by the door 111 described above.

Various components may be accommodated in the inner space (S) for the laundry treating apparatus 100 to treat laundry. For example, a compressor (not shown) for a laundry treating process associated with the transfer of heat, such as drying treatment, may be accommodated therein. Furthermore, a tub and a drum inserted into the tub (not shown) may be provided in the the inner space (S).

In addition, a hose member (not shown) communicating between inside and the outside of the housing 100 may be provided inside the main body 110 so as to allow the inflow of wash water required to treat laundry. One side of the hose member (not shown) may be inserted into the main body 110, and the other side of the hose member (not shown) may be connected to a faucet or the like.

Furthermore, the inside and outside of the main body 110 may be electrically conducted to each other. By the electrical conduction, power for operation may be supplied to the laundry treating apparatus 100.

In addition, as shown in FIG. 4, the detergent supply device 200 may be provided in the inner space (S). The detergent supply device 200 may be stably supported by a support member 243 coupled to pass through a rear surface of the main body 110.

Figure 5:
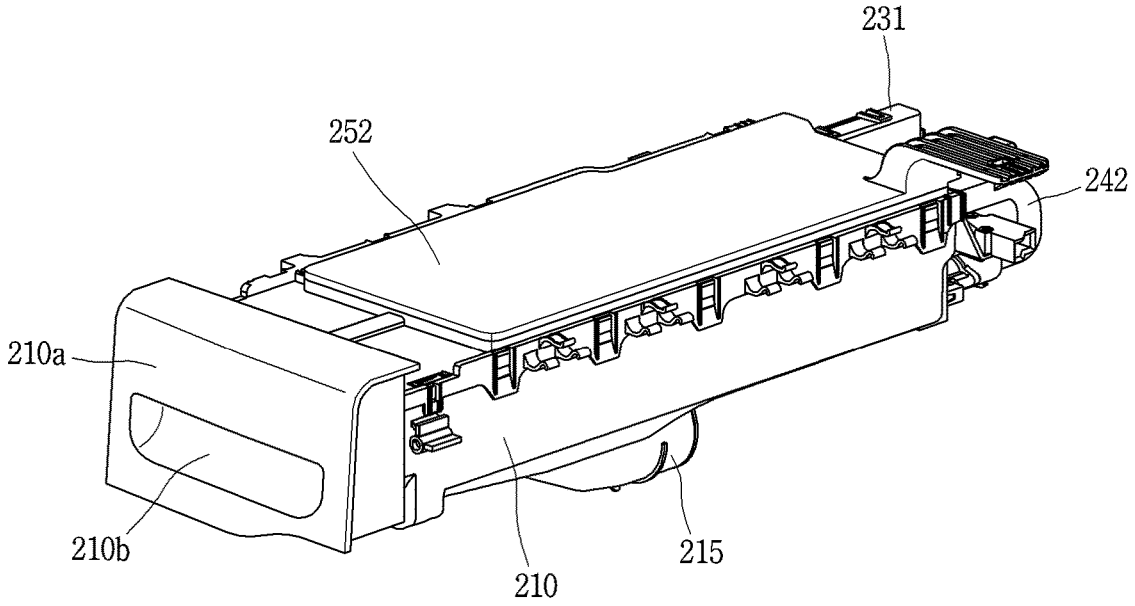
FIG. 5 is a perspective view showing an appearance of the detergent supply device in FIG. 4.
Figure 6:
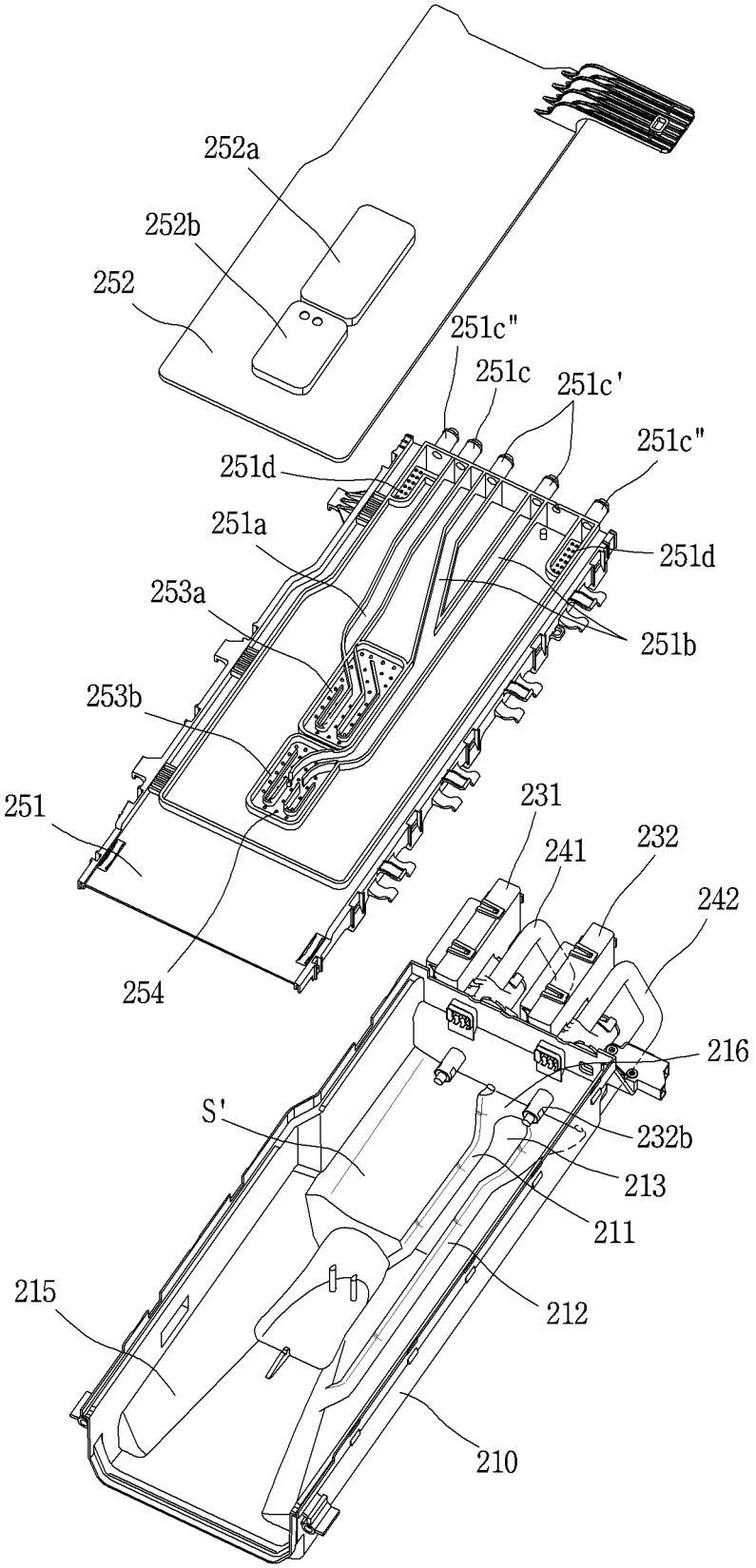
FIG. 6 is an exploded view of the detergent supply device in FIG. 5.
Figure 7:
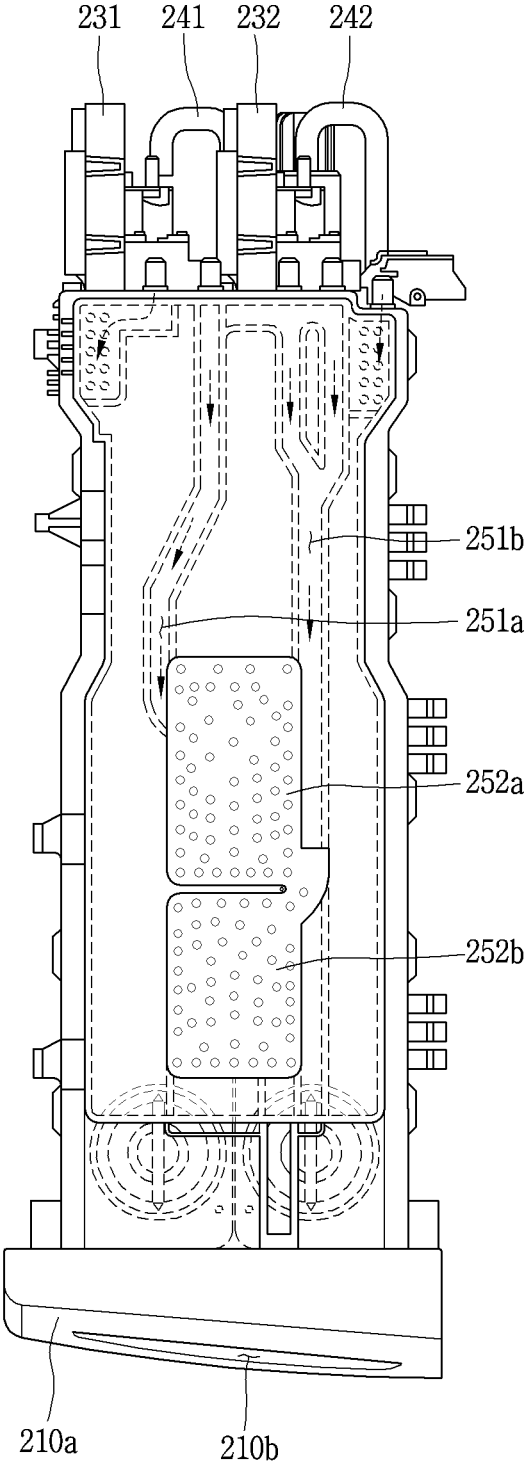
FIG. 7 is a plan view of the detergent supply device.

FIG. 5 is a perspective view showing an appearance of the detergent supply device 200 in FIG. 4, and FIG. 6 is an exploded view of the detergent supply device 200 in FIG. 5. Furthermore, FIG. 7 is a plan view of the detergent supply device 200.

The detergent supply device 200 according to the present disclosure may include a housing 210, first and second storage containers 221, 222 mounted on a storage container frame 210*d*, a wash water dispenser 251 and a dispenser cover 252.

The detergent supply device 200 may be connected to an operation unit provided on a front portion of the main body 110 so as to be electrically conducted, and power signals and control signals received through the operation unit 113 may be transmitted to the detergent supply device 200.

The detergent supply device 200 may supply detergent, softener or bleach to the tub (not shown) according to the received power signals and control signals.

In other words, the wash water dispenser 251 may be fixedly provided inside the main body 110, and when the storage container frame 210*d* coupled to each storage container 221, 222 is inserted into the housing 210 located inside the main body 110, as shown in FIG. 5, the wash water dispenser 251 may have a structure located on an upper portion of the housing 210.

The wash water dispenser 251 serves to form a movement path of wash water by introducing wash water from a faucet or the like. When the storage container frame 210*d* is mounted on the main body 110, the wash water dispenser 251 provided inside the main body 110 are located to face each storage container 221, 222 mounted on the storage container frame 210*d*.

The dispenser cover 252 may be coupled to an upper portion of the wash water dispenser 251 to cover the wash water dispenser 251.

The wash water dispenser 251 may be disposed with wash water passages 251*a*, 251*b* extending along a predetermined shape along the surface to guide the movement of wash water flowing in along a wash water inlet portion 251*c*, 251*c'*.

The wash water passages 251*a*, 251*b* may be composed of a first wash water passage 251*a* and a second wash water passage 251*b* that are spaced apart from each other, and disposed on a rear surface of the wash water dispenser 251 to communicate with the wash water inlet portion 251*c*, 251*c'* so as to allow wash water to flow therein. For example, the first wash water passage 251*a* may be configured to communicate with the first wash water inlet portion 251*c*, and the second wash water passage 251*b* may be configured to communicate with another second wash water inlet portion 251*c'*.

In addition, as shown in FIG. 6, a third wash water inlet portion 251" for supplying wash water may be further disposed on a rear surface of the wash water dispenser 251. Wash water is supplied to the third wash water inlet portion 251", and supplied toward the wash water supply portions 251*d* formed on both side portions of the wash water dispenser 251.

The wash water supply portion 251*d* may be referred to as a rear shower portion.

When wash water is supplied to each wash water supply portion 251*d*, the wash water may be discharged through a plurality of holes arranged in each wash water supply portion 251*d* to be supplied to the housing 210. Specifically, the wash water discharged through each wash water supply portion 251*d* may be supplied to a gap disposed between the storage container frame 210*d* (or each laundry detergent storage container 221, 222) and the housing 210, and the wash water flowing out through the gap may move to the housing 210. This is because the wash water supply portion 251*d* is located on an upper side of the gap, and as a result, the wash water may be mixed with laundry detergent while flowing in toward a lower surface of the housing 210 to which the laundry detergent is added, and then may move toward the detergent input hole 214.

At this time, an inclined surface (S') having an inclination in one direction may be disposed at one side of a lower surface of a rear portion of the housing 210. The inclined surface (S') may have an inclination in a direction toward laundry detergent passages 211, 212, and as a result, wash water falling through the wash water supply portion 251*d* may move toward the laundry detergent passages 211, 212 along the inclined surface (S').

Each of the wash water passages 251*a*, 251*b* may be disposed along both side walls that protrude and extend constantly. When the dispenser cover 252 is coupled to the wash water dispenser 251, it is defined a closed space allowing wash water to move, and thus wash water may move toward each wash water receiving portion 253*a*, 253*b* along the wash water passage 251*a*, 251*b*.

Each of the wash water passages 251*a*, 251*b* may extend toward each of the wash water receiving portions 253*a*, 253*b* disposed at one side surface of the wash water dispenser 251.

The wash water passage 251*a*, 251*b* may include a first wash water passage 251*a* and a second wash water passage 251*b*. As shown in FIG. 7, the first wash water passage 251*a* may communicate with the first wash water inlet portion 251*c* to flow wash water therein. The first wash water passage 251*a* may serve to guide the movement of the wash water toward the first wash water receiving portion 253*a*.

The first wash water receiving portion 253*a* may be provided with a space in which wash water moving along the first wash water passage 251*a* is accommodated. A plurality of wash water movement holes 254 may be disposed in the first wash water receiving portion 253*a*, and wash water received in the first wash water receiving portion 253*a* may be discharged through the wash water movement holes 254.

Furthermore, the second wash water receiving portion 253*b* may be disposed at a position adjacent to the first wash water receiving portion 253*a* to communicate with the second wash water passage 251*b* so as to accommodate moving wash water.

As shown in FIG. 7, wash water moving along the second wash water passage 251*b* may be accommodated in the second wash water receiving portion 253*b*, and then discharged through the plurality of wash water movement holes 254.

In addition, according to the washing process, wash water may be supplied to the third wash water inlet portion 251", and supplied toward the wash water supply portions 251*d* disposed on both side portions of the wash water dispenser 251.

When wash water is supplied to each wash water supply portion 251*d*, the wash water may be discharged through a plurality of holes arranged in each wash water supply portion 251*d* to move to a gap disposed between the storage container frame 210*d* (or each laundry detergent storage container 221, 222) and the housing 210, and then flow in toward a lower surface of the housing 210. Accordingly, wash water may move toward a front portion of the housing while being mixed with the laundry detergent and move to the detergent input hole 214.

The detergent input hole 214 may be disposed at a lower center portion of the housing 210. The detergent input hole 214 may be configured to communicate with the tub (not shown) of the laundry treating apparatus 100, and thus laundry detergent mixed with wash water may be moved toward the detergent input hole 214 and then supplied to the tub (not shown).

Specifically, when the storage container frame 210*d* is inserted into the housing 210 located inside the main body 110, the first wash water receiving portion 253*a* may be located to vertically overlap with the softener housing receiving portion 223 of the housing 210. Accordingly, fabric softener that is manually added toward the softener housing accommodating portion 223 or moves along the first laundry detergent passage 211, which will be described later, may be mixed with wash water discharged through the first wash water receiving portion 253*a* and discharged through the detergent input hole 214 to be supplied to the tub.

Likewise, when the storage container frame 210*d* is inserted into the housing 210 provided inside the main body 110, the second wash water receiving portion 253*b* may be located to vertically overlap with the manual detergent dispensing unit 223' of the housing 210.

Accordingly, powder detergent manually supplied by the user or liquid detergent moving along the second laundry detergent passage 212, which will be described later, may be mixed with wash water moving in a downward direction through the plurality of wash water movement holes 254 arranged in the second wash water receiving portion 253*b*, and supplied to the tub through the detergent input hole 214.

The dispenser cover 252 may have a rectangular plate shape, and may be coupled to the wash water dispenser 251. When the dispenser cover 252 is coupled to the wash water dispenser 251, the first and second wash water passages 251*a*, 251*b* disposed in the wash water dispenser 251 may be sealed.

The dispenser cover 252 may be provided to cover the wash water dispenser 251. At this time, one side of the dispenser cover 252 may be disposed with a first wash water receiving protrusion 252*a* and a second wash water receiving protrusion 252*b* to vertically overlap with the first wash water receiving portion 253*a* and the second wash water receiving portion 253*b* disposed at the wash water dispenser 251.

The first wash water receiving protrusion 252*a* and the second wash water receiving protrusion 252*b* are respectively disposed to protrude in an upward direction, to define a movement path of wash water moving along each wash water passage 251*a*, 251*b*.

Figure 8:
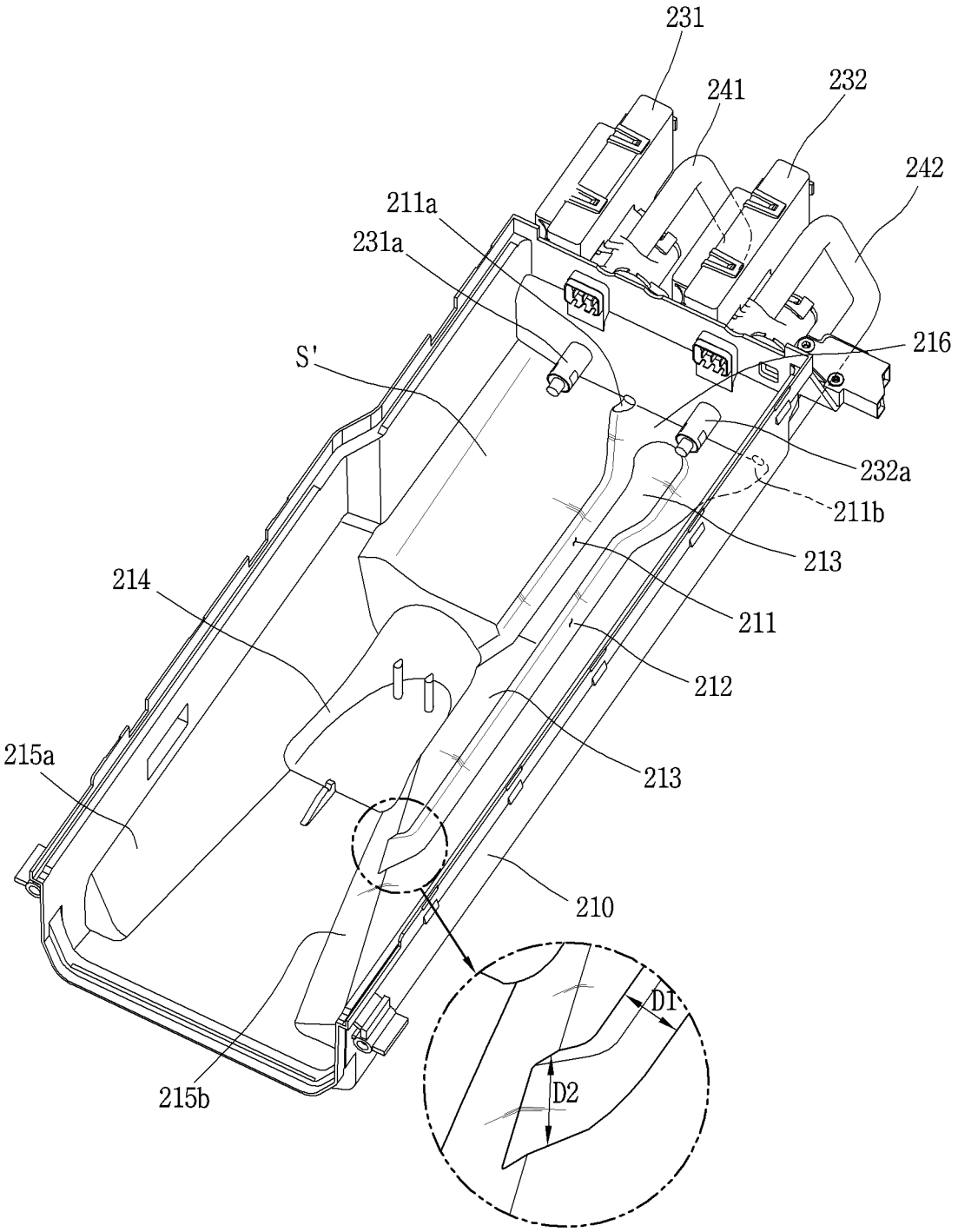
FIG. 8 is a perspective view showing a housing of the laundry treating apparatus according to the present disclosure.

FIG. 8 is a perspective view showing a state of the housing 210 of the detergent supply device 200 according to the present disclosure.

On a lower surface of the housing 210, the laundry detergent passages 211, 212 may be disposed to extend from the rear portion toward the front portion to move each laundry detergent introduced by the laundry detergent pump 231, 232.

Furthermore, the detergent input hole 214 may be disposed at a lower center portion of the housing 210. Here, a lower surface of the housing 210 is configured to be inclined at a predetermined angle from the rear portion to the front portion to efficiently move each laundry detergent toward the detergent input hole 214.

As shown in FIG. 8, the detergent input hole 214 may be disposed at a lower center of the housing 210, and the detergent input hole 214 may communicate with the tub (not shown) of the laundry treating apparatus 100 to supply laundry detergent and wash water to the tub (not shown) along an inclined lower surface of the housing 210.

The laundry detergent passages 211, 212 may be disposed to extend in a direction toward the detergent input hole 214, and the detergent input hole 214 communicates with the tub (not shown) of the laundry treating apparatus 100, and thus laundry detergent moving along an inclined bottom surface of the housing 210 may be supplied to the tub (not shown) after passing through the detergent input hole 214 along with wash water.

The laundry detergent passage 211, 212 may include a first laundry detergent passage 211 that guides the movement of first laundry detergent, and a second laundry detergent passage 212 disposed at a different position by interposing a separation wall 213 therebetween to guide the movement of second laundry detergent.

Both ends of the first laundry detergent passage 211 and the second laundry detergent passage 212 may be configured to communicate with a rear surface of the housing 210 and the detergent input hole 214, respectively, to move laundry detergent from the rear surface of the housing toward the detergent input hole 214.

The separation wall 213 is disposed on a lower surface of the housing 210, and may be configured to protrude upward. Through the separation wall 213, the first laundry detergent passage 211 and the second laundry detergent passage 212 may be separated from each other.

The separation wall 213 has a structure protruding to have a predetermined height on a lower surface of the housing 210, and may be disposed extend along a gap between the first laundry detergent passage 211 and the second laundry detergent passage 212 from a rear surface of the housing 210 to an inclined portion 215*b*. The respective laundry detergent passages 211, 212 may be separated from each other by the separation wall 213. The separation wall 213 may extend to a rear end portion of the housing 210, but when wash water is supplied by the wash water supply portion 251*d*, which will be described later, the separation wall 213 may be preferably disposed from a position spaced apart by a predetermined distance from the rear end portion of the housing 210 such that laundry detergent added along both side walls of the housing 210 is more efficiently mixed with wash water.

Furthermore, at least part of the first and second laundry detergent passages 211, 212 may be separated by the separation wall 213, and for example, respective rear portions of the first laundry detergent passage 211 and the second laundry detergent passage 212 constituting the first and second laundry detergent passages 211, 212 may be configured to communicate with each other by interposing the separation wall 213 therebetween.

As a result, as shown in FIG. 8, the first laundry detergent passage 211 and the second laundry detergent passage 212 disposed with the separation wall 213 therebetween may be configured to communicate with each other at one side on a rear surface of the housing 210 to form a washing passage 216 for washing. Washing water may be supplied to the washing passage 216 to remove residual laundry detergent in which softener and detergent remaining in the washing passage 216 are fused or adhered to each other.

When detergent and fabric softener are mixed with each other, there occurs a problem in which sediment is fused or adhered to the housing 210. In particular, there is a concern that laundry detergent is fused or adhered to remain at a rear edge of the housing 210. In order to prevent this, the washing passage 216 may be disposed at a rear portion of the housing 210 to communicate between the first laundry detergent passage 211 and the second laundry detergent passage 212 so as to supply washing water to the housing washing passage 216, thereby effectively removing laundry detergent that may remain at the edge.

In addition, the washing passage 216 may be configured in a rounded shape, rather than an angled edge shape at a rear portion of the separation wall 213 to prevent laundry detergent from being fused or adhered.

When detergent and fabric softener are mixed with each other, sediment may be generated. However, in case of the present disclosure, the laundry detergent moving along the first laundry detergent passage 211 and laundry detergent moving along the second laundry detergent passage 212 may be prevented from being mixed with each other to prevent the generation of sediment on a lower surface of the housing 210. At this time, the lengths of flow paths of the first laundry detergent passage 211 and the second laundry detergent passage 212 may be defined differently. Through this, it may be possible not only to change the movement speed of wash water, but also to efficiently wash powder detergent by wash water in the laundry detergent passage even when the powder detergent is supplied through the manual detergent dispensing unit 223'.

The first laundry detergent passage 211 and the second laundry detergent passage 212 may be configured to have different overall lengths extending from a rear surface of the housing 210 to the detergent input hole 214.

For example, as shown in FIG. 8, the second laundry detergent passage 212 may be configured to have an overall length greater than the first laundry detergent passage 211, and configured to extend along the inclined portion 215*b* to a front side of the housing 210 than the first laundry detergent passage 211. Through this, even though the powder detergent is distributed over a wide area through the manual detergent dispensing unit 223', it can be washed out more easily.

At least either one of the first laundry detergent passage 211 and the second laundry detergent passage 212 may be disposed to extend to the inclined portion 215*b*.

Each laundry detergent passage 211, 212 may be extended to communicate with the laundry detergent inlet hole 211*a*, 211*b* and the detergent input hole 214 disposed on a rear surface of the housing 210, respectively.

By the operation of the laundry detergent pump, first laundry detergent and second laundry detergent flowing from a rear portion of the housing 210 along the laundry detergent passages 211, 212 may move toward the detergent input hole 214. Specifically, the laundry pumps 231, 232 may server to supply laundry detergent accommodated in the first storage container 221 and the second storage container 222 on a rear surface of the housing 210 through the laundry detergent inlet holes 211*a*, 211*b*. Furthermore, as shown in FIG. 8, inclined portions 215*a*, 215*b* having a predetermined inclination may be disposed in a direction toward the detergent input hole 214 at either one side of the housing 210.

In addition, the inclined portions 215*a* 215*b* having a predetermined inclination in a direction toward the detergent input hole 214 may be disposed on both sides of a lower surface of the housing 210, respectively. In this case, the inclined portions 215*a*, 215*b* may be inclined at a predetermined angle to define a front input portion of the detergent input hole 214.

Through the inclined portions 215*a*, 215*b*, each laundry detergent moving along the first laundry detergent passage 211 and the second laundry detergent passage 212 may efficiently move toward the detergent input hole 214 by its own weight.

At this time, at least either one of the first laundry detergent passage 211 and the second laundry detergent passage 212 has a structure in which a width of the flow path gradually increases toward the rear side, thereby efficiently performing the movement of laundry detergent moving along the first laundry detergent passage 211 and the second laundry detergent passage 212. For example, at least either one of the first laundry detergent passage 211 and the second laundry detergent passage 212 may be disposed to increase in width in a region adjacent to the inclined portion 215*b*.

In addition, the detergent supply device 200 according to another embodiment of the present disclosure, as shown in an enlarged portion in FIG. 8, the first laundry detergent passage 211 and the second laundry detergent passage 212 may be respectively disposed to increase in width in a direction toward the detergent input hole 214 from the inclined portion 215*b*.

Accordingly, when wash water falls toward the inclined portion 215*b*, each laundry detergent is mixed by the wash water, and efficiently added toward the detergent input hole 214 without any remaining amount.

For example, a width (D1) of the second laundry detergent passage 212 may be configured to be greater than a width (D2) disposed along the inclined portion 215*b*. In this case, when wash water falls toward the inclined portion 215*b*, laundry detergent may be efficiently added to the detergent input hole 214 without the remaining amount, and powder detergent added through the manual detergent dispensing unit 223' may also be efficiently washed by the wash water to move to the detergent input hole 214. Specifically, powder detergent added through the manual detergent dispensing unit 223' may fall into the detergent input hole 214 or the inclined portion 215*a*, 215*b* to be supplied to the housing 210.

In other words, the wash water is not only supplied toward a lower portion of the housing 210 to which laundry detergent is added, but also dropped toward the inclined portion 215*b* to be supplied to a peripheral portion of the detergent input hole 214, thereby moving toward the detergent input hole 214 in a state of being well mixed with laundry detergent.

Figure 9:
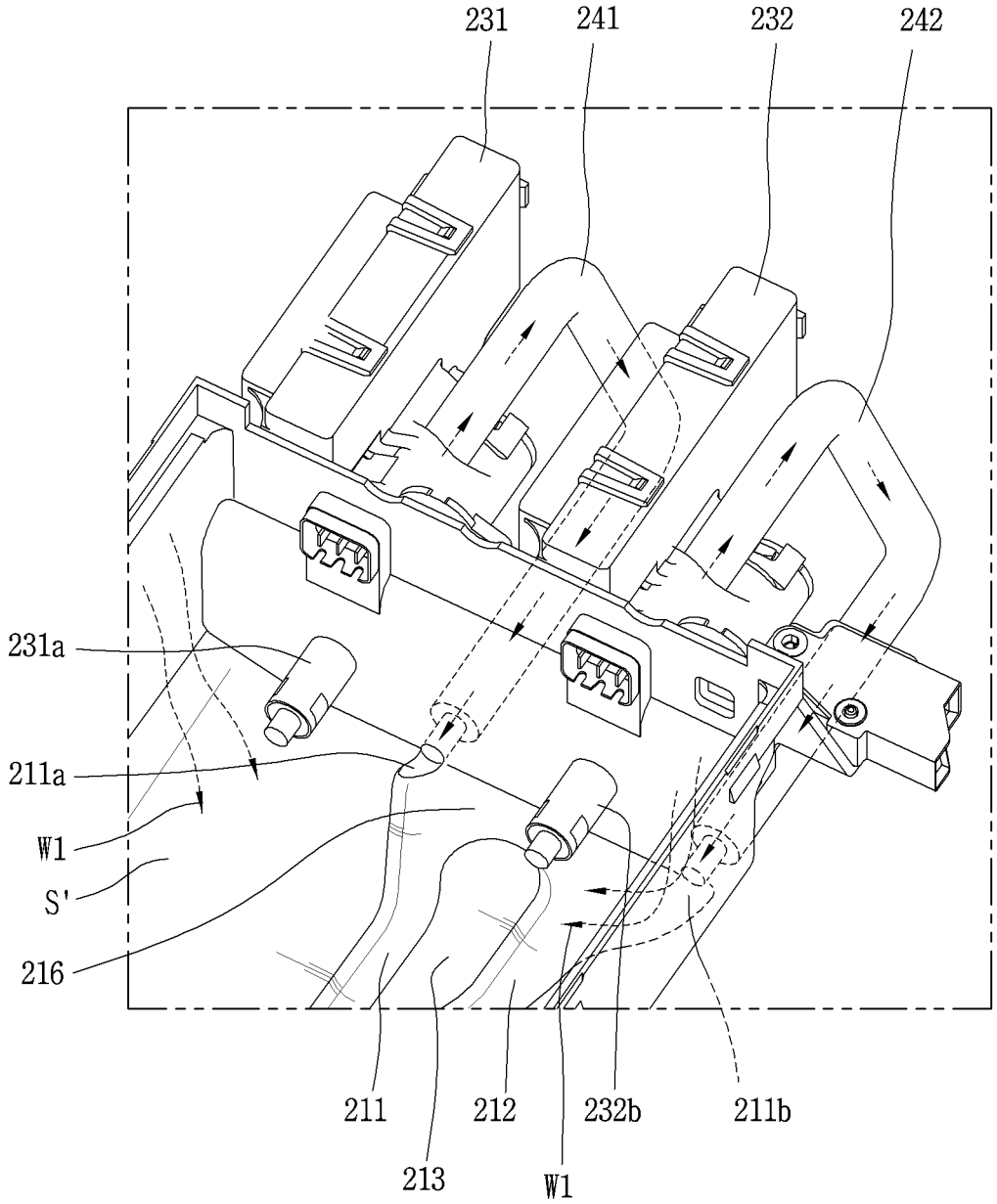
FIG. 9 is an enlarged view showing a state of laundry detergent flowing into the housing by a laundry detergent pump.

FIG. 9 is an enlarged view showing a state of laundry detergent flowing into the housing by the laundry detergent pump 231, 232.

The laundry detergent pumps 231, 232 for performing the movements of different laundry detergents, respectively, may be provided at a rear portion of the housing 210.

Laundry detergent stored in each storage container 221, 222 may be discharged through a discharge port (not shown) disposed at a rear portion of the each storage container 221, 222 by the operation of the laundry detergent pump 230, and the discharged laundry detergent may be introduced into the housing 210, and mixed with the wash water introduced into the housing 210, and then supplied to the tub (not shown).

When the first storage container 221 and the second storage container 222 are mounted on the housing 210, laundry detergent accommodated in each storage container 221, 222 may be supplied to the tub (not shown) by the laundry detergent pumps 231, 232.

The laundry detergent pump 231, 232 serves to form a transport force for performing the movement of laundry detergent, and may include a first laundry detergent pump 231 and a second laundry detergent pump 232.

The first laundry detergent pump 231 serves to inhale laundry detergent stored in the first storage container 221 through a first laundry detergent suction pipe 231*a*, and then to discharge toward the first laundry detergent inlet hole 211*a* through a first laundry detergent input pipe 241. The laundry detergent discharged through the first laundry detergent inlet hole 211*a* may move along the first laundry detergent passage 211.

Likewise, the second laundry detergent pump 232 serves to inhale laundry detergent stored in the second storage container 222 through a second laundry detergent suction pipe 232*b*, and then to discharge toward the second laundry detergent inlet hole 211*b* through a second laundry detergent input pipe 242.

The laundry detergent discharged through the second laundry detergent inlet hole 211*b* may move along the second laundry detergent passage 212.

At this time, the first laundry detergent passage 211 and the second laundry detergent passage 212 may be spaced apart from each other with the separation wall 213 disposed on a lower surface of the housing 110 therebetween, and each laundry detergent moving along the first laundry detergent passage 211 and the second laundry detergent passage 212 may be prevented from being mixed with each other.

In addition, when wash water is supplied to the wash water supply portion 251*d* disposed on both sides of the wash water dispenser 251 by the third wash water inlet portion 251", wash water (W) may flow in toward a lower surface of the housing 210 to which laundry detergent is added while moving along both side walls of the housing 210. Accordingly, the wash water W may flow toward the detergent input hole 214 after being mixed with laundry detergent.

Figure 10:
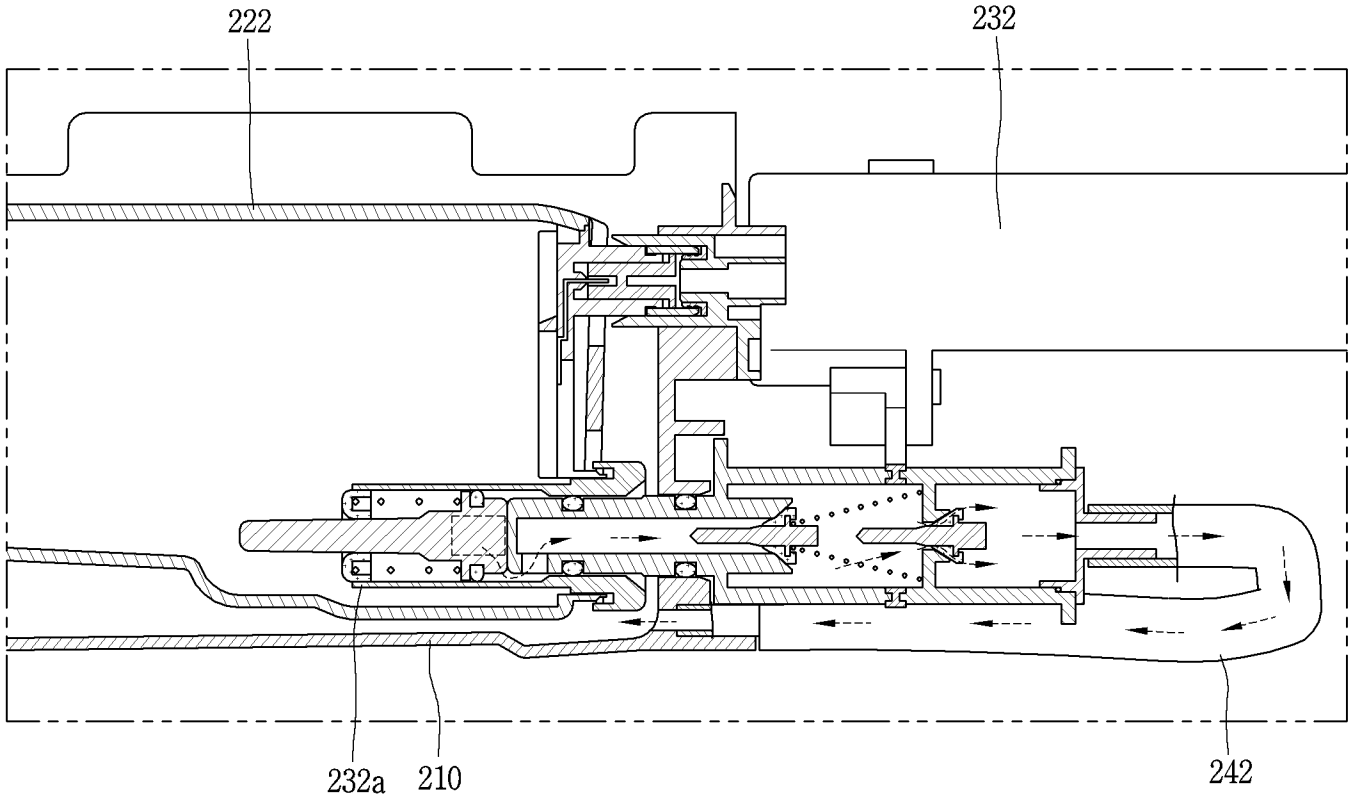
FIG. 10 is a transverse cross-sectional view of the detergent supply device.

FIG. 10 is a transverse cross-sectional view of the detergent supply device 200.

When the storage container frame 210*d* is inserted into the housing 210 provided inside the main body 110, the first wash water receiving portion 253*a* may be located to vertically overlap with the softener housing receiving portion 223 of the housing 210. Likewise, when the storage container frame 210*d* is inserted into the housing 210 provided inside the main body 110, the second wash water receiving portion 253*b* may be located to vertically overlap with the manual detergent dispensing unit 223' of the housing 210.

As a result, laundry detergent stored in each storage container 221, 222 by the operation of the laundry detergent pump 230 provided at a rear portion of the each storage container 221, 222 may flow into the housing 210, and then move along the first laundry detergent passage 211 and the second laundry detergent passage 212.

The laundry detergent suction portion 231*a*, 231*b* disposed to protrude from the laundry detergent pump 231, 232 to communicate with an inside of the storage container 221, 222 may be disposed at a rear portion of each storage container 221, 222.

Specifically, the first laundry detergent suction portion 231*a* protruding from the first laundry detergent pump 231 may be located in a state of being accommodated in the first storage container 221, and thus laundry detergent stored in the first storage container 221 may be sucked by the operation of the first laundry detergent pump 231, and discharged through the first laundry detergent inlet hole 211*a* via the first laundry detergent input pipe 241.

Furthermore, the second laundry detergent suction part 232*a* protruding from the second laundry detergent pump 232 may be located in a state of being accommodated in the second storage container 222, and thus laundry detergent stored in the second storage container 222 may be sucked by the operation of the second laundry detergent pump 232, and discharged through the second laundry detergent inlet hole 211*b* via the second laundry detergent input pipe 242.

At this time, wash water may be introduced through the wash water inlet portions 251*c*, 251*c'*, 251*c"* disposed in the wash water dispenser 251, and the introduced wash water may be moved along the first and second wash water passages 251*a*, 251*b*, and then discharged toward the inclined portion 215*b* through the wash water movement hole 254.

Wash water may be mixed with laundry detergent moving toward the detergent input hole 214 along the first laundry detergent passage 211 and the second laundry detergent passage 212, and may move downward by its own weight, and then be supplied towards the tub (not shown).

In other words, laundry detergent moving into the housing 210 from each storage container 221, 222 through the detergent input hole 214 may be moved along the first and second laundry detergent passages 211, 212, and then mixed with wash water flowing into the housing 210, and then supplied to the tub (not shown) through the detergent input hole 214.

The foregoing description is merely embodiments for implementing a detergent supply device according to the present disclosure and a laundry treating apparatus including the same, and the present disclosure is not limited to the above embodiments, and various modifications and improvements will become apparent to those skilled in the art without departing from the concept and scope of the present disclosure as disclosed in the following claims.

What is claimed is:

1. A detergent supply device, comprising:

a housing;

a storage container frame located in the housing and withdrawable from the housing;

a plurality of storage containers provided at the storage container frame and configured to receive laundry detergent; and a plurality of laundry detergent pumps located at the housing and configured to pump the laundry detergent from the plurality of storage containers, wherein the plurality of storage containers include a first storage container configured to receive a first laundry detergent and a second storage container configured to receive a second laundry detergent, wherein the housing defines a laundry detergent passage at a lower surface of the housing to guide the first and the second laundry detergents toward a detergent input hole of the housing, wherein the laundry detergent passage includes a first laundry detergent passage and a second laundry detergent passage divided by at least one separation wall, wherein a first pump of the plurality of laundry detergent pumps is configured to pump the first laundry detergent from the first storage container to the first laundry detergent passage and a second pump of the plurality of laundry detergent pumps is configured to pump the second laundry detergent from the second storage container to the second laundry detergent passage, and wherein each of the first and second laundry detergents is (i) mixed with wash water supplied to the housing and (ii) discharged through the detergent input hole.

2. The detergent supply device of claim 1, wherein:

the first laundry detergent passage is configured to guide movement of the first laundry detergent; and the second laundry detergent passage is spaced apart from the first laundry detergent passage and configured to guide movement of the second laundry detergent, and the first laundry detergent passage and the second laundry detergent passage are separated from each other with the at least one separation wall therebetween to block mixing of the first and second laundry detergents.

3. A detergent supply device, comprising:

a housing;

a storage container frame located in the housing and withdrawable from the housing;

a plurality of storage containers provided at the storage container frame and configured to receive laundry detergent; and a plurality of laundry detergent pumps located at the housing and configured to pump the laundry detergent from the plurality of storage containers, wherein the plurality of storage containers include a first storage container configured to receive a first laundry detergent and a second storage container configured to receive a second laundry detergent, wherein the housing defines a laundry detergent passage at a lower surface of the housing to guide the first and the second laundry detergents toward a detergent input hole of the housing, wherein the laundry detergent passage includes a first laundry detergent passage and a second laundry detergent passage divided by at least one separation wall, wherein a first pump of the plurality of laundry detergent pumps is configured to pump the first laundry detergent from the first storage container to the first laundry detergent passage and a second pump of the plurality of laundry detergent pumps is configured to pump the second laundry detergent from the second storage container to the second laundry detergent passage, wherein the first laundry detergent passage is configured to guide movement of the first laundry detergent, wherein the second laundry detergent passage is spaced apart from the first laundry detergent passage and configured to guide movement of the second laundry detergent, wherein the first laundry detergent passage and the second laundry detergent passage are separated from each other with the at least one separation wall therebetween to block mixing of the first and second laundry detergents, and wherein the lower surface of the housing comprises an inclined portion that is located at one side of the housing with a predetermined inclination toward the detergent input hole.

4. The detergent supply device of claim 3, wherein the separation wall extends along a gap between the first laundry detergent passage and the second laundry detergent passage from a rear surface of the housing toward the inclined portion.

5. The detergent supply device of claim 3, wherein at least one of the first laundry detergent passage or the second laundry detergent passage extends to the inclined portion.

6. The detergent supply device of claim 5, wherein at least one of the first laundry detergent passage or the second laundry detergent passage increases in width in a region adjacent to the inclined portion.

7. The detergent supply device of claim 2, wherein both of the first and second laundry detergent passages are connected with a rear surface of the housing and the detergent input hole to establish fluid communication.

8. The detergent supply device of claim 7, wherein the plurality of laundry detergent pumps are configured to supply laundry detergent from the first and second storage containers to the rear surface of the housing.

9. A detergent supply device, comprising:

a housing;

a storage container frame located in the housing and withdrawable from the housing;

a plurality of storage containers provided at the storage container frame and configured to receive laundry detergent; and a plurality of laundry detergent pumps located at the housing and configured to pump the laundry detergent from the plurality of storage containers, wherein the plurality of storage containers include a first storage container configured to receive a first laundry detergent and a second storage container configured to receive a second laundry detergent, wherein the housing defines a laundry detergent passage at a lower surface of the housing to guide the first and the second laundry detergents toward a detergent input hole of the housing, wherein the laundry detergent passage includes a first laundry detergent passage and a second laundry detergent passage divided by at least one separation wall, and wherein a first pump of the plurality of laundry detergent pumps is configured to pump the first laundry detergent from the first storage container to the first laundry detergent passage and a second pump of the plurality of laundry detergent pumps is configured to pump the second laundry detergent from the second storage container to the second laundry detergent passage, wherein the first laundry detergent passage is configured to guide movement of the first laundry detergent, wherein the second laundry detergent passage is spaced apart from the first laundry detergent passage and configured to guide movement of the second laundry detergent, wherein the first laundry detergent passage and the second laundry detergent passage are separated from each other with the at least one separation wall therebetween to block mixing of the first and second laundry detergents, wherein both of the first and second laundry detergent passages are connected with a rear surface of the housing and the detergent input hole to establish fluid communication, and wherein the first and second laundry detergent passages are connected with each other at a rear portion of the housing to form a washing passage.

10. A detergent supply device, comprising:

a housing;

a storage container frame located in the housing and withdrawable from the housing;

a plurality of storage containers provided at the storage container frame and configured to receive laundry detergent; and a plurality of laundry detergent pumps located at the housing and configured to pump the laundry detergent from the plurality of storage containers, wherein the plurality of storage containers include a first storage container configured to receive a first laundry detergent and a second storage container configured to receive a second laundry detergent, wherein the housing defines a laundry detergent passage at a lower surface of the housing to guide the first and the second laundry detergents toward a detergent input hole of the housing, wherein the laundry detergent passage includes a first laundry detergent passage and a second laundry detergent passage divided by at least one separation wall, wherein a first pump of the plurality of laundry detergent pumps is configured to pump the first laundry detergent from the first storage container to the first laundry detergent passage and a second pump of the plurality of laundry detergent pumps is configured to pump the second laundry detergent from the second storage container to the second laundry detergent passage, wherein the first laundry detergent passage is configured to guide movement of the first laundry detergent, wherein the second laundry detergent passage is spaced apart from the first laundry detergent passage and configured to guide movement of the second laundry detergent, wherein the first laundry detergent passage and the second laundry detergent passage are separated from each other with the at least one separation wall therebetween to block mixing of the first and second laundry detergents, and wherein the first and second laundry detergent passages have different lengths from a rear surface of the housing to the detergent input hole.

11. The detergent supply device of claim 1, further comprising:

a wash water dispenser oriented to face an upper portion of each of the first and the second storage containers to form a movement path that guides flow of wash water into the first and the second storage containers; and wash water suppliers that are located at both sides of a rear portion of the wash water dispenser and that are configured to supply the wash water in a downward direction through a plurality of holes of the wash water suppliers.

12. The detergent supply device of claim 11, wherein a gap that has a predetermined width exists between the housing and the storage container frame, and wherein one of the wash water suppliers is located at an upper side of the gap.

13. A detergent supply device, comprising:

a housing;

a storage container frame located in the housing and withdrawable from the housing;

a plurality of storage containers (i) provided at the storage container frame and configured to receive laundry detergent and (ii) including a first storage container configured to receive a first laundry detergent and a second storage container configured to receive a second laundry detergent;

a manual detergent dispenser that is located between the first storage container and the second storage container and that is configured to dispense laundry detergent added by a user; and a plurality of laundry detergent pumps located at the housing and configured to pump the laundry detergent from the plurality of storage containers, wherein the housing defines a laundry detergent passage at a lower surface of the housing to guide the first and the second laundry detergents toward a detergent input hole of the housing, wherein the laundry detergent passage includes a first laundry detergent passage and a second laundry detergent passage divided by at least one separation wall, and wherein a first pump of the plurality of laundry detergent pumps is configured to pump the first laundry detergent from the first storage container to the first laundry detergent passage and a second pump of the plurality of laundry detergent pumps is configured to pump the second laundry detergent from the second storage container to the second laundry detergent passage.

14. The detergent supply device of claim 13, wherein powder detergent added through the manual detergent dispenser falls into a detergent input hole or an inclined portion of the housing.

15. A laundry treating apparatus, comprising:

a tub located inside a main body of the laundry treating apparatus;

a drum rotatably located inside the tub; and a detergent supply device configured to supply laundry detergent to the tub, the detergent supply device being inserted into or withdrawn from a front surface of the main body, wherein the detergent supply device comprises:

a housing, a storage container frame located in the housing and withdrawable from the housing, a plurality of storage containers provided at the storage container frame and configured to receive laundry detergent, and a plurality of laundry detergent pumps located at the housing and configured to pump the laundry detergent from the plurality of storage containers, wherein the plurality of storage containers include a first storage container configured to receive a first laundry detergent and a second storage container configured to receive a second laundry detergent, wherein the housing defines a laundry detergent passage at a lower surface of the housing to guide the first and the second laundry detergents toward a detergent input hole of the housing, wherein the laundry detergent passage includes a first laundry detergent passage and a second laundry detergent passage divided by at least one separation wall, wherein a first pump of the plurality of laundry detergent pumps is configured to pump the first laundry detergent from the first storage container to the first laundry detergent passage and a second pump of the plurality of laundry detergent pumps is configured to pump the second laundry detergent from the second storage container to the second laundry detergent passage, and wherein each of the first and second laundry detergents is (i) mixed with wash water supplied to the housing and (ii) discharged through the detergent input hole.

16. The laundry treating apparatus of claim 15, wherein:

the first laundry detergent passage is configured to guide movement of the first laundry detergent, and the second laundry detergent passage is spaced apart from the first laundry detergent passage and configured to guide movement of the second laundry detergent.

17. The laundry treating apparatus of claim 16, wherein both of the first and second laundry detergent passages are connected with a rear portion of the housing and the detergent input hole, to move the first and the second laundry detergents from the rear portion of the housing to the tub through the detergent input hole.

18. The laundry treating apparatus of claim 17, wherein the lower surface of the housing comprises an inclined portion that is located at one side of the housing with a predetermined inclination toward the detergent input hole, and wherein the first laundry detergent passage and the second laundry detergent passage increase in width in a region adjacent to the inclined portion and are oriented toward the detergent input hole.

* * * * *